US007112920B2

(12) United States Patent
Yamamoto et al.

(10) Patent No.: US 7,112,920 B2
(45) Date of Patent: Sep. 26, 2006

(54) FIELD EMISSION SOURCE WITH PLURAL EMITTERS IN AN OPENING

(75) Inventors: Makoto Yamamoto, Takarazuka (JP); Keisuke Koga, Soraku-gun (JP); Akinori Shiota, Ibaraki (JP); Seigo Kanemaru, Tsukuba (JP); Masayoshi Nagao, Tsukuba (JP)

(73) Assignee: National instutute of advanced industrial science and technology, Tokyo (JP)

( * ) Notice: Subject to any disclaimer, the term of this patent is extended or adjusted under 35 U.S.C. 154(b) by 182 days.

(21) Appl. No.: 10/827,813

(22) Filed: Apr. 20, 2004

(65) Prior Publication Data

US 2005/0001536 A1 Jan. 6, 2005

(30) Foreign Application Priority Data

Apr. 21, 2003 (JP) ..... 2003-116089

(51) Int. Cl.
*H01J 63/02* (2006.01)
*H01J 1/304* (2006.01)
*H01J 1/46* (2006.01)

(52) U.S. Cl. ..... 313/497; 313/309; 313/310; 313/495; 313/496

(58) Field of Classification Search ..... 313/309–311, 313/495–497

See application file for complete search history.

(56) References Cited

U.S. PATENT DOCUMENTS 5,552,659 A * 9/1996 Macaulay et al. ..... 313/310
5,589,728 A * 12/1996 Levine et al. ..... 313/336
5,608,283 A * 3/1997 Twichell et al. ..... 313/309
6,225,739 B1 * 5/2001 Xia ..... 313/495
6,400,068 B1 * 6/2002 Jaskie et al. ..... 313/309
6,472,802 B1 * 10/2002 Choi et al. ..... 313/309
2002/0067113 A1 * 6/2002 Forbes et al. ..... 313/309
2002/0079802 A1 * 6/2002 Inoue et al. ..... 313/309
2002/0185949 A1 * 12/2002 Yaniv et al. ..... 313/309
2003/0001476 A1 * 1/2003 Chang ..... 313/309

FOREIGN PATENT DOCUMENTS

EP 0 637 050 A2 2/1995
JP 9-270228 10/1997

OTHER PUBLICATIONS

C. A. Spindt, "A Thin-Film Field-Emission Cathode", *J. Appl. Phys.* Feb. 19, 1968, vol. 39, p. 3504-5, 1968.
H.F. Gray et al., "A Vacuum Field Effect Transistor Using Silicon Field Emitter Arrays", *IEDM Tech Dig,* p. 776-9, 1986.
K. Betsui, "Fabrication and Operation of Silicon Micro-Field-Emitter-Array." *Digest of the Conference of the Institute of Electronics, Information and Communication Engineers.* Autumn, 1990, SC-8-2, p. 5-282, 5-283.

* cited by examiner

*Primary Examiner*—Allen C. Ho
(74) *Attorney, Agent, or Firm*—Hamre, Schumann, Mueller & Larson, P.C.

(57) ABSTRACT

A field emission electron source capable of achieving large current density is provided at low cost with good productivity. An insulating layer is formed on a substrate and has one or more openings; and an extraction electrode is formed on the insulating layer. In one or more of the openings, a plurality of emitters, each of which emits an electron by an electric field from the extraction electrode, are formed on the substrate.

18 Claims, 16 Drawing Sheets

Standard
θ=0deg
0.7μm Pitch
Density=×1.0

θ=20deg
0.47μm Pitch
Density=×1.5

θ=30deg
0.43μm Pitch
Density=×1.6

θ=45deg
0.35μm Pitch
Density=×2.0

FIELD EMISSION SOURCE WITH PLURAL EMITTERS IN AN OPENING

FIELD OF THE INVENTION

The present invention relates to a field emission electron source. In particular, it relates to a field emission electron source that is a cold cathode type electron source expected to be applied for a flat-type solid display device or an ultra-speed micro vacuum device and is capable of achieving a large current operation.

BACKGROUND OF THE INVENTION

In accordance with the development of fine processing technology of semiconductors, the formation of micro field emission cathodes becomes possible. Spindt et al. proposed a cone type electron emission cathode, so that a micro field emission electron source has drawn attention (reference document 1: C. A. Spindt, J. Appl. Phys. Vol. 39, p. 3504 (1968)).

A structure and manufacturing method of a field emission cathode proposed by Spindt is shown as a first conventional example in FIGS. 11A to 11D.

Referring to FIG. 11A, on the surface of a conductive substrate 101, an insulating layer 102 and a metal film 103 that functions as a gate are formed in this order. Then, a small opening 104 penetrating the metal film 103 and the insulating layer 102 to expose the conductive substrate 101 is formed by a general photolithography process.

Referring to FIG. 11B, then, a sacrificial layer 105 made of alumina is vapor-deposited at a shallow angle with respect to the substrate 101 so as to cover the metal film 103. With this step, the opening diameter of a gate formed by the metal film 103 is reduced.

Referring to FIG. 11C, thereafter, a metal 106 such as molybdenum that becomes an emitter is vapor-deposited perpendicular to the substrate 101. Since the opening diameter of the gate is reduced when vapor deposition is carried out, a cone-shaped emitter (cathode) 107 is formed inside the small opening 104.

Referring to FIG. 11D, then the unnecessary sacrificial layer 105 and metal 106 are removed by a lift-off method by etching with respect to the sacrificial layer 105. This device is operated by emitting an electron into vacuum by applying an electric voltage to a metal film 103 from the tip of the emitter 107 and receiving the emitted electrode with an anode electrode (positive electrode) (not shown) additionally disposed opposite to the emitter 107.

Thereafter, there have been proposed methods for forming a cold cathode having the similar vertical structure with the tip of the emitter sharper by using a crystal anisotropy etching of silicon or dry etching and thermal oxidation (reference document 2: H. F. Gray et al., IEDM Tech Dig. P. 776 (1986); reference document 3: Betsui, "Digest of the conference of The Institute of Electronics, Information and Communication Engineers, Autumn, 1990, SC-8-2(1990)"). A structure and manufacturing method of a field emission cathode proposed by Betsui et al. is shown as a second conventional example in FIG. 12A to 12E.

Referring to FIG. 12A, on a silicon substrate 111, an oxide film 112 is formed. Referring to FIG. 12B, by using this oxide film 112, a disk-shaped etching mask 113 is formed by a photolithography process.

Referring to FIG. 12C, then, a tapered three-dimensional shaped portion 114 is formed under the etching mask 113 by carrying out a dry etching under the conditions where side etching is present. Furthermore, by carrying out thermal oxidation, the periphery of the three-dimensional shape portion 114 is changed into a thermal oxide film 115. Thereby, a cone-shaped portion 116 made of silicon is formed inside.

Referring to FIG. 12D, an insulating film 117 such as an oxide silicon film and a metal film 118 that functions as a gate electrode are vapor-deposited in the direction perpendicular to the surface of the substrate 111, thereby attaching the insulating film 117 and the metal film 118 onto the etching mask 113 and the thermal oxide film 115.

Referring to FIG. 12E, finally by soaking in hydrofluoric acid, a thermal oxide film 115 in the vicinity of a cone-shaped portion 116 is removed, and at the same time, the etching mask 113 to which the insulating film 117 and the metal film 118 are attached is removed, thereby forming an electron source having a structure similar to the structure of the above-mentioned Spindt type electron source.

This electron source is operated by applying an electric voltage to the metal film 118 that functions as a gate electrode so as to emit electron into vacuum from the tip 119 of the cone-shaped emitter 116, and receiving the emitted electrode with an anode electrode (positive electrode) (not shown) additionally disposed opposite to the emitter 116.

On the other hand, the present inventor group has proposed a tower-shaped electron source capable of operating at lower voltage (see, EP 637050A2). A manufacturing method of this towered-shaped electron source is shown as a third conventional example in FIG. 13A to 13H.

Referring to FIG. 13A, an oxide silicon film is formed on a (100) surface of a silicon crystal substrate 121 by a thermal oxidation method, and processed into a disk-shaped micro etching mask 122B having a diameter of 1 μm or less by photolithography.

Referring to FIG. 13B, then, by carrying out anisotropic dry etching with respect to the silicon substrate 121 using the micro etching mask 122B, a cylindrical body 124A made of silicon is formed under the micro etching mask 122B.

Referring to FIG. 13C, thereafter, by carrying out crystal anisotropic etching with respect to this cylindrical body 124A, a drum-shaped body 124B with a side face formed of a surface including (331) face and a top portion including a pair of opposite cylindrical bodies is formed.

Referring to FIG. 13D, then, a thin first thermal oxide film 125 is formed on the upper side of the drum-shaped body 124B and on the surfaces of the silicon substrate 121. Referring to FIG. 13E, thereafter, by carrying out an anisotropic dry etching with respect to a silicon substrate 121 by using a micro etching mask 122B, a column shaped body 124C is formed under the drum-shaped body 124B.

Referring to FIG. 13F, then, by a thermal oxidation method, on the surfaces of the drum-shaped column body 124C (FIG. 13E) and the silicon substrate 121, a second thermal oxide film 126 is formed. Thereby, inside the drum-shaped column 124C, a tower-shaped cathode 127 having a micro diameter and a steep tip portion is formed.

Referring to FIG. 13G, on the etching mask 122B and on the substrate 121 in the vicinity of the micro etching mask 122B, an insulating film 128 and a metal film 129 are sequentially deposited by vapor deposition.

Referring to FIG. 13H, furthermore, by carrying out wet etching with respect to a second thermal oxide film 126, the micro etching mask 122B and the insulating film 128 and metal film 129 formed on the micro etching mask 122B are removed. Thereby, the tower-shaped cathode 127 is exposed and at the same time, an extraction electrode 129A made of metal film having the same size as the inner diameter of the micro etching mask 122B is formed.

Since the electron source shown in the first to third conventional examples mentioned above has a micro diameter of a gate opening, a field emission current can be obtained with a relatively low voltage.

Furthermore, for the purpose of increasing the emission current, the present inventor group has proposed an electron source by forming a porous silicon film on a surface of the convex microstructure by an anodic oxidation method, thereby emitting electrons from micro protruding portions on the surface of the porous silicon film (JP 9 (1997)-270288A). A structure and manufacturing method of the electron source are shown as a fourth conventional example in FIG. 14A to 14E.

Referring to FIG. 14A, on the surface of a silicon substrate 131, a porous silicon layer 132 is formed by an anodic oxidation method. Referring to FIG. 14B, then, on the porous silicon layer 132, an oxide silicon film containing phosphorus is deposited by a CVD method, and furthermore, a disk-shaped etching mask 133 having a radius of about 1 μm is formed thereon by photolithography.

Referring to FIG. 14C, by dry-etching the porous silicon layer 132 and the silicon substrate 131 in the vicinity of the etching mask 133, a convex structure 136 is formed.

Referring to FIG. 14D, a silicon oxide film 134 and a metal electrode 135 are vapor-deposited by using an etching mask 133 as a mask for vapor deposition. Referring to FIG. 14E, finally, by soaking in hydrofluoric acid, the etching mask 133 is dissolved so as to remove the oxide silicon film 134 and the metal electrode 135 deposited on the etching mask 133. Thus, an electron source is completed.

In this case, by applying a voltage between the silicon substrate 131 and a metal electrode 135, an electric field is concentrated on the protruding tip on the surface of the porous silicon layer 132 formed by anodic oxidation and electrons are emitted. According to this method, on the surface of the porous silicon layer 132 formed inside the open portion of the metal electrode 135, substantially numerous protruding portions, which are formed by an anodic oxidation step, are formed, and electron beams are emitted from a large number of protruding portions. Thus, a field emission electron source with a large current density can be obtained.

However, in the electron sources described in the first to third conventional examples, in order to increase the current density, gate open portions corresponding to each emitter were required to be arranged in an array at high density. In these electron sources, since space between the emitters are separated from each other by an insulating layer, when the pitches between the opening portions are narrowed in order to increase the density of the emitter arrangement, the insulating layer as a separation wall becomes thin. Therefore, gate electrode may be peeled off.

When the film thickness of the insulating layer is made to be thin, the problem may be avoided. However, since the resistant voltage of the insulating layer is reduced, a voltage sufficient to extract electrodes cannot be applied. As a result, large current cannot be obtained.

On the other hand, in the fourth conventional example mentioned above, since a general semiconductor manufacturing line does not have an anodic oxidation step, this step is required to be added, thus increasing the cost. In addition, sufficient evaluation and analysis, etc. of the effect on the other steps is required. Furthermore, when the anodic oxidation step is actually added, many problems about mass production, for example, controllability of the anodic oxidation step and uniformity of the surface of the porous silicon layer, etc., have to be clarified.

SUMMARY OF THE INVENTION

It is an object of the present invention to provide a field emission electron source capable of achieving a large current density at low cost with high mass productivity.

The field emission electron source according to the present invention includes an insulating layer that is formed on a substrate and has one or more openings; and an extraction electrode formed on the insulating layer. In one or more openings, a plurality of emitters, each of which emits an electron by an electric field applied from the extraction electrode, are formed on the surface of the substrate.

DETAILED DESCRIPTION OF THE INVENTION

Figure 1A:
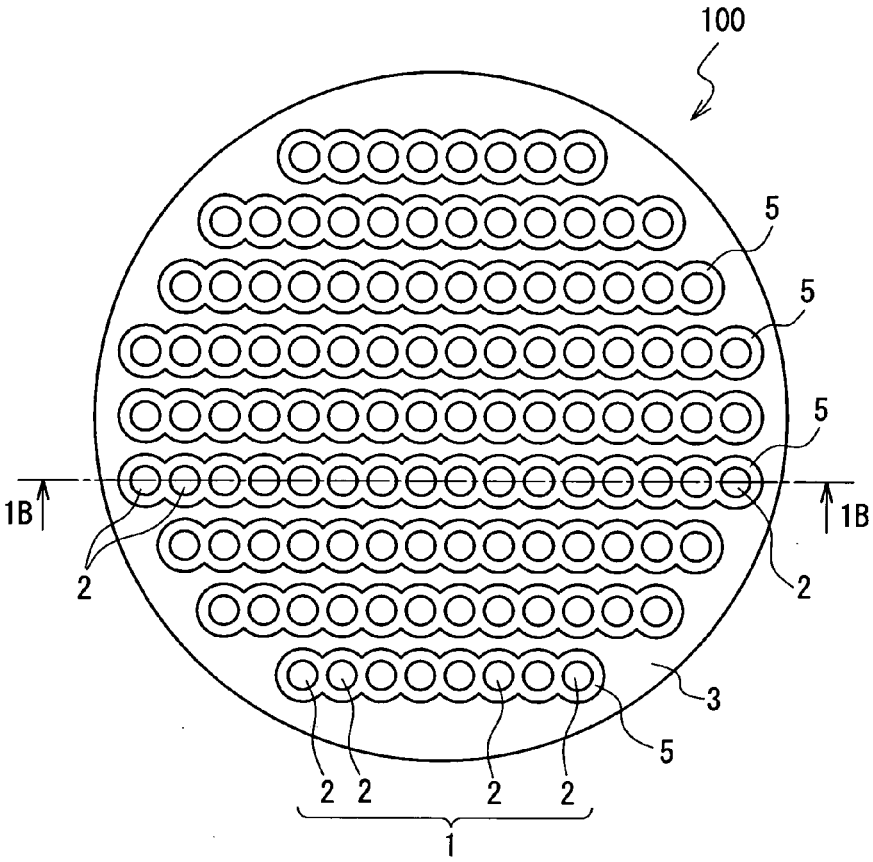
FIG. 1A is a plan view showing a configuration of a field emission electron source according to Embodiment 1.

According to the field emission electron source of the present embodiments, in one or more of the openings of an insulating layer formed on a substrate, a plurality of emitters, each of which emits electron by an electric field from the extraction electrode, are formed on the substrate. Therefore, as compared with a conventional configuration in which only one emitter is formed in a single opening, emitters can be arranged at high density. Further, unlike the protruding portion formed on the surface of the porous silicon layer that needs an additional anodic oxidation method, a general photolithography technology may be used so as to arrange emitters at high density. As a result, it is possible to provide a field emission electron source with high density of electric current.

It is preferable that each emitter is a conductive protruding microstructure having a steep tip on the surface thereof. Thus, an electric field from the extraction electrode is concentrated on the tip, so that an electron can be emitted easily even with low voltage.

It is preferable that a clearance between each emitter and the extraction electrode is smaller than a distance between the center of the emitter and the center of the other adjacent emitter. It is advantageous because an electric field from the extraction electrode to the emitter is made more stable by approaching the extraction electrode to the emitter.

It is preferable that the plurality of emitters in the opening are arranged substantially linearly. Thus, an electric field from the extraction electrode acting on a plurality of emitters provided in one opening becomes plane-symmetric with respect to the direction of the arrangement of the emitters, and electric field acting on each emitter is respectively uniform. Therefore, stable current emission can be achieved with low voltage.

It is preferable that the plurality of openings have substantially an elongated-hole shape and the plurality of openings are arranged in a plurality of rows. Thus, since a larger number of emitters can be arranged in one opening, and the electric field from the extraction electrode acting on a plurality of emitters becomes uniform, stable current emission can be achieved with large current density.

It is preferable that the plurality of emitters in the opening are arranged substantially in an arc shape. The electric field from the extraction electrode acting on a plurality of emitters provided in one opening becomes approximately plane-symmetric with respect to the direction of arrangement of emitters (circumferential direction), and electric field acting on each emitter becomes uniform respectively. Therefore, stable current emission can be achieved with low voltage. Furthermore, when the emitters are used for an electron source for CRT used for, for example, TV monitor and the like, if the emitters are arranged in an arch shape, electron beams can be converged on an extremely small spot, so that the resolution of image can be improved.

It is preferable that when an angle made by a line connecting the centers of the adjacent emitters and a virtual line connecting between a center of the emitter and an interrupted portion of the periphery of the opening of the extraction electrode is made to be θ, the angle θ is in the range from 15° to 45°. When the angle is smaller than 15°, emitters cannot be arranged with high density. When the angle is larger than 45°, extraction electrode cannot surround the emitters sufficiently, thus deteriorating the electron emission property.

It is preferable that the extraction electrode is formed so that it surrounds the plurality of the openings. It is advantageous because electric field from the extraction electrode to a plurality of emitters in the opening can be made uniform.

It is preferable that the extraction electrode is extended onto the opening of the insulating layer and has an electrode opening formed along each of the plurality of emitters in the opening. It is advantageous because the clearance between the extraction electrode and the emitter is further reduced, and the electric field from the extraction electrode to each emitter can be made more stable.

It is preferable that not less than one of the plurality of emitters in the opening is surrounded by the other emitters. It is advantageous because the arrangement density of the emitters is enhanced, resulting in increasing the current density. Since the extraction electrode is extended onto the opening of the insulating layer, even if the emitter is surrounded by the other emitters and separated from the insulating layer, the electric field from the extraction electrode extending onto the opening of the insulating layer to the emitter surrounded by the other emitters can be made stable.

It is preferable that the plurality of emitters in the opening are arranged in two rows. It is advantageous because emitters can be arranged at high density as compared with the arrangement in one row.

Hereinafter, the present invention will be described by way of an embodiment with reference to the drawings.

EMBODIMENT 1

Figure 1B:
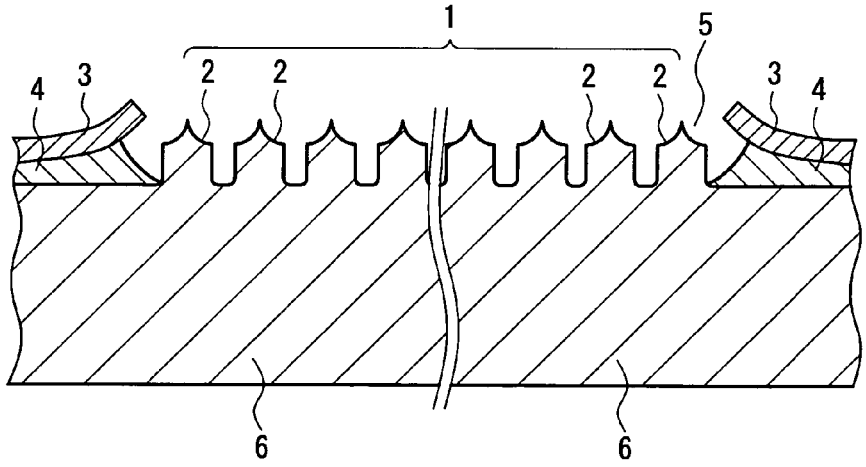
FIG. 1B is a cross-sectional view taken on line 1B—1B of FIG. 1A.

FIG. 1A is a plan view showing a configuration of a field emission electron source 100 according to Embodiment 1; and FIG. 1B is a cross-sectional view taken on line 1B—1B of FIG. 1A.

The field emission electron source 100 is provided with a disk-shaped silicon substrate 6. Impurities are introduced in the silicon substrate 6 in order to reduce resistance.

On the substrate 6, an insulating layer 4 having a plurality of openings 5 each having substantially an elongated-hole shape arranged in parallel with each other at predetermined intervals. On the insulating layer 4, an extraction electrode 3 is formed so that it surrounds the opening 5 of the insulating layer 4.

In each opening 5, an emitter group 1 is provided. The emitter group 1 includes plurality of emitters 2 aligned in a row along the opening 5 having substantially an elongated opening shape. Each emitter 2 is formed on the surface of the silicon substrate 6. A predetermined voltage is applied to the emitters 2 and the extraction electrode 3, and by the electric field from the extraction electrode 3, electrons are emitted from the emitters 2.

Each emitter 2 is configured by a conducive convex microstructure having a steep tip on the surface thereof A clearance between each emitter 2 in the opening 5 and the extraction electrode 3 is smaller than the distance from the center of the emitter 2 to the center of the other adjacent emitter 2. The clearance between the emitter 2 and the extraction electrode 3 herein means a clearance between the emitter 2 and the extraction electrode 3 seen from the direction perpendicular to the substrate 6. In other words, the clearance means a distance, along the surface of the substrate, between the extraction electrode 3 projected onto the substrate 6 and the emitter 2 when the extraction electrode 3 is projected on the surface of the substrate 6.

Referring to FIGS. 2A to 2K, a method for manufacturing the thus configured field emission electron source 100 will be explained.

Figure 2A:
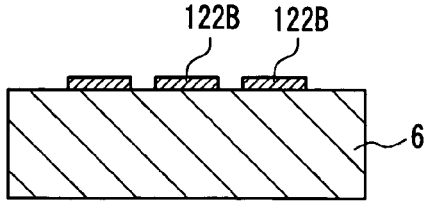
FIGS. 2A to 2K are cross-sectional views showing a method for manufacturing a field emission electron source according to Embodiment 1.

Referring to FIG. 2A, an oxide silicon film is formed on a (100) surface of a silicon crystal substrate 6 by a thermal oxidation method, and processed into a plurality of disk-shaped micro etching masks 122B having a diameter of 1 μm or less by photolithography.

Figure 2B:
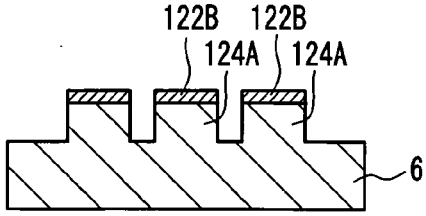

Referring to FIG. 2B, then, by carrying out anisotropic dry etching with respect to the silicon substrate 6 using the micro etching masks 122B, a plurality of cylindrical bodies 124A made of silicon are formed under the micro etching masks 122B.

Figure 2C:
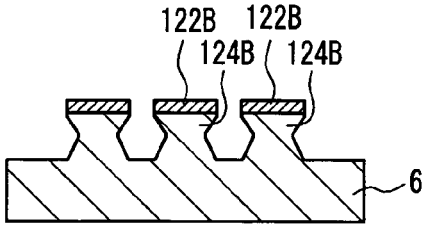

Referring to FIG. 2C, thereafter, by carrying out crystal anisotropic etching with respect to this cylindrical bodies 124A, drum-shaped bodies 124B, each of which has a side face formed of a surface including (331) face and a top portion including a pair of opposite cylindrical bodies, are formed.

Figure 2D:
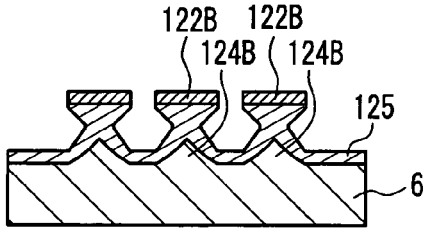
Figure 2E:
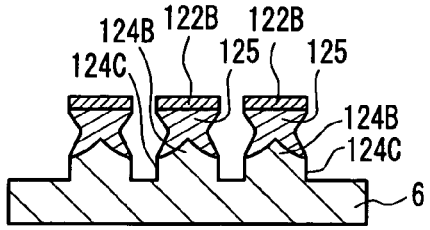

Referring to FIG. 2D, then, a thin first thermal oxide film 125 is formed on the upper side of the drum-shaped bodies 124B and on the surfaces of the silicon substrate 6. Referring to FIG. 2E, thereafter, by carrying out an anisotropic dry etching with respect to a silicon substrate 6 by using the micro etching masks 122B, column shaped bodies 124C are formed under the drum-shaped bodies 124B.

Figure 2F:
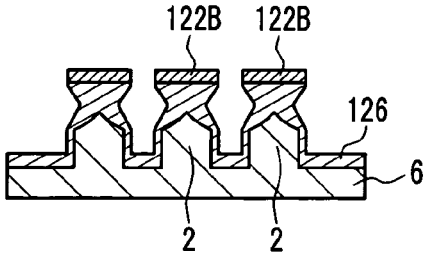

Referring to FIG. 2F, then, by a thermal oxidation method, on the surfaces of the drum-shaped column bodies 124C (FIG. 2E) and the silicon substrate 6, a second thermal oxide film 126 is formed. Thereby, inside the drum-shaped column bodies 124C, a plurality of tower-shaped emitters 2 having a micro diameter and a steep tip portion are formed.

Figure 2G:
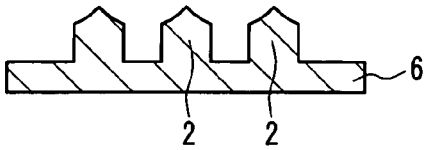

Referring to FIG. 2G, the etching masks 122B, thin first thermal oxide film 125 and the second oxide film 126 are removed from the substrate 6 and a plurality of emitters 2 are left by using hydrofluoric acid.

Figure 2H:
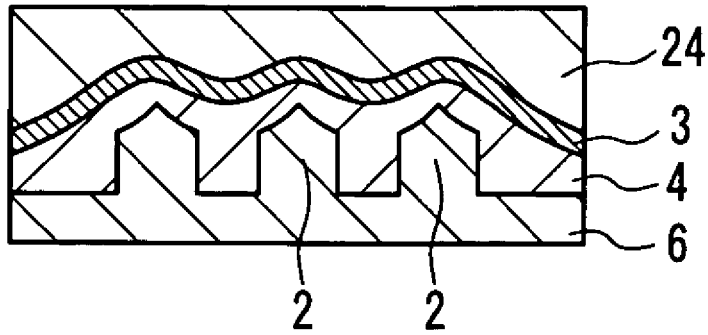

Referring to FIG. 2H, an insulating layer 4 is formed on the silicon substrate 6 so that it covers the plurality of emitters 2 and an extraction electrode 3 made of polysilicon film is formed on the insulating layer 4. The insulating layer 4 and the extraction electrode 3 on the emitters 2 are formed in a shape approximately along the shape of the upper surfaces of the emitters 2. However, since a clearance between the emitters 2 is narrow and is embedded early when the insulating layer is formed, the extraction electrode 3 on the emitter 2 is formed slightly higher than the outside the emitter region and at the same time, slightly flattened. Thereafter, a flattened film 24 including photoresist or application type insulating film is formed on the extraction electrode 3 and thus the entire surface of the substrate is flattened.

Figure 2I:
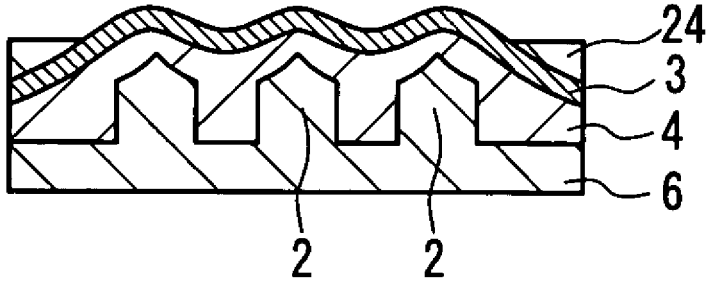
Figure 2J:
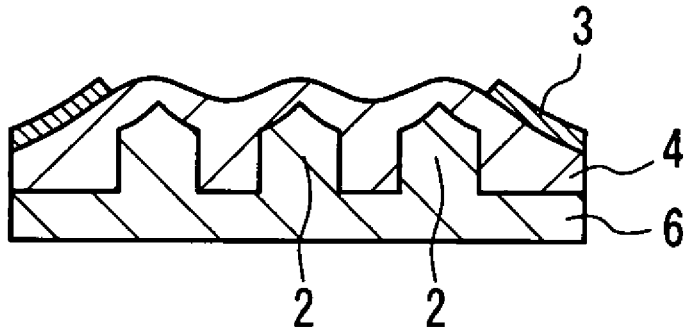

Referring to FIG. 2I, thereafter, the surface of the flattened film 24 is uniformly etched until only the extraction electrode 3 on the plurality of emitters 2 is exposed. Referring to FIG. 2J, when the exposed extraction electrode 3 over the plurality of emitters 2 is being etched, in the surrounding portion of the plurality of emitters 2, an opening of the extraction electrode 3 is self-aligned. Self-aligning herein denotes the following phenomenon. That is to say, when the flattened flat film are etched, since a part of the extraction electrode 3 formed protruding on the upper part of the emitters 2 is etched, the openings of the extraction electrode 3 are formed in accordance with the shape of the emitters 2. That is to say, by the shape of the emitters 2, the shape of the opening of the extraction electrode 3 is automatically determined.

Figure 2K:
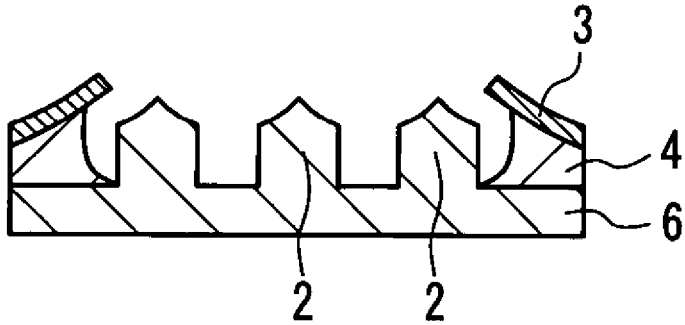

Referring to FIG. 2K, thereafter, the insulating layer 4 in the opening portion of the extraction electrode 3 is removed by wet etching such as with hydrofluoric acid so as to expose the emitters 2.

At this time, a dot diameter of a micro etching masks 122B is made to about 0.5 μm so as to make the space (a region to be etched) between the micro etching masks 122B for forming a plurality of emitters 2 in the emitter group 1 to be narrowed to the theoretical resolution limitation of an exposure to be used. In Embodiment 1, a dot diameter of micro etching mask 122B is made to be 0.5 μm and a space between the micro etching masks 122B is made to be 0.2 μm. Furthermore, a distance between the nearest emitters 2 of the different groups 1 is maintained to be a distance capable of structurally leaving an insulating layer 4 for separating the emitter groups. In Embodiment 1, a distance between the centers of the nearest emitters 2 of the different groups 1 is set to be 1.2 μm.

In this way, subject to an exposure limitation technology of the photolithography process, the emitter group 1 can be formed at high density.

However, considering the mechanical strength of the emitter, the minimum dimension of the emitter is made to be preferably about 0.1 μm. For example, when an emitter with a diameter of 0.1 μm is formed, the distance from the center of the emitter to the center of the other adjacent emitter is set to be preferably 0.3 μm. In this way, a clearance between the emitters becomes 0.2 μm. Note here that in also considering the yield with respect to a uniformity of inner portions of the emitters etc., it is preferable that the diameter of the emitter is about 0.3 μm and the clearance between the emitters is about 0.2 μm. Furthermore, as the distance between the emitters narrows, the effect of the present invention is improved, and the distance from the center of the emitter to the center of the other adjacent emitter is preferably about 2.0 μm or less.

In the thus configured field emission electron source 100, with respect to the substrate 6, positive voltage is applied to the extraction electrode 3, and an electron is emitted from the tip of each of the plurality of emitters 2 by electric field effect.

In Embodiment 1, in order to form the emitter 2 at high density by using a general semiconductor process capable of forming a fine pattern, an electron source is formed by using a silicon substrate. However, the present invention is not necessarily limited to this. The requirement of the present invention is not a process to be used but achieving high-density arrangement of emitters by forming a plurality of emitters in the same opening. Therefore, a glass substrate may be used and an electrode layer formed on the surface thereof. Also, a conductive substrate such as a metal substrate may be used.

Furthermore, Embodiment 1 describes an example of the emitter 2 in which a steep tip portion is provided on the surface of the protruding structure. However, the tip portion of the protruding portion may be provided with materials such as a high melting point metal or a low work function material, etc.

Furthermore, a plurality of emitters 2 may be formed on at least one of the plurality of the openings 5 in the insulating layer 4.

As mentioned above, according to Embodiment 1, a plurality of emitters 2, each of which emits electron by the electric field from the extraction electrode 3, are formed on the substrate 6 in the plurality of openings 5 of the insulating layer 4 formed on the substrate 6. Therefore, as compared with a conventional configuration in which only one emitter is formed in a single opening, emitters can be arranged at high density. Further, emitters can be arranged at high density by using general photolithography. As a result, it is possible to provide a field emission electron source with high density of electric current.

EMBODIMENT 2

Figure 3:
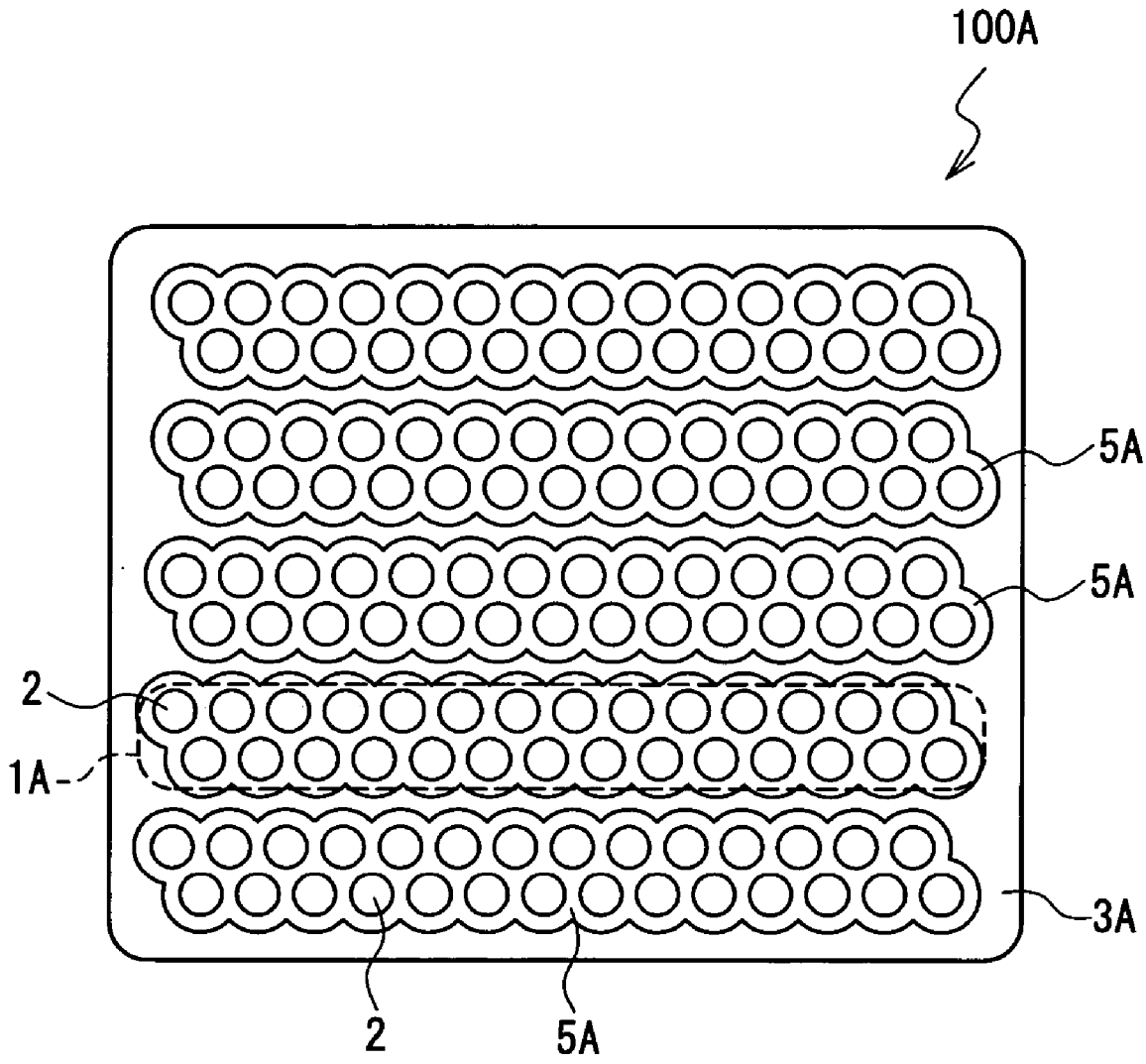
FIG. 3 is a plan view showing a configuration of a field emission electron source according to Embodiment 2.

FIG. 3 is a plan view showing a configuration of a field emission electron source 100A according to Embodiment 2. The component elements having the same configurations as the field emission electron source 100 in Embodiment 1 described with the reference to FIGS. 1A and 1B are denoted with the same reference numerals as those therein, and the description thereof will be omitted here.

In Embodiment 2, a plurality of emitters 2 constituting the emitter group 1A are arranged in two rows so that the two rows are shifted out of registry by a half pitch. Pitch (the relationship between the dot diameter of the micro etching mask and the space between dots) between the emitters 2 constituting the emitter group 1A is the same as shown in Embodiment 1.

Also in Embodiment 2, it is apparent that open portions 5A of the extraction electrode 3A are formed in a self-aligned manner with respect to the emitter group 1A.

In Embodiment 2, an electric field to each emitter 2 from the extraction electrode 3A becomes regionally non-uniform unlike the above-mentioned Embodiment 1. Therefore, although the voltage applied to the extraction electrode 3A tends to be high, since the emitters are arranged at higher density, consequently high current density can be obtained.

EMBODIMENT 3

Figure 4:
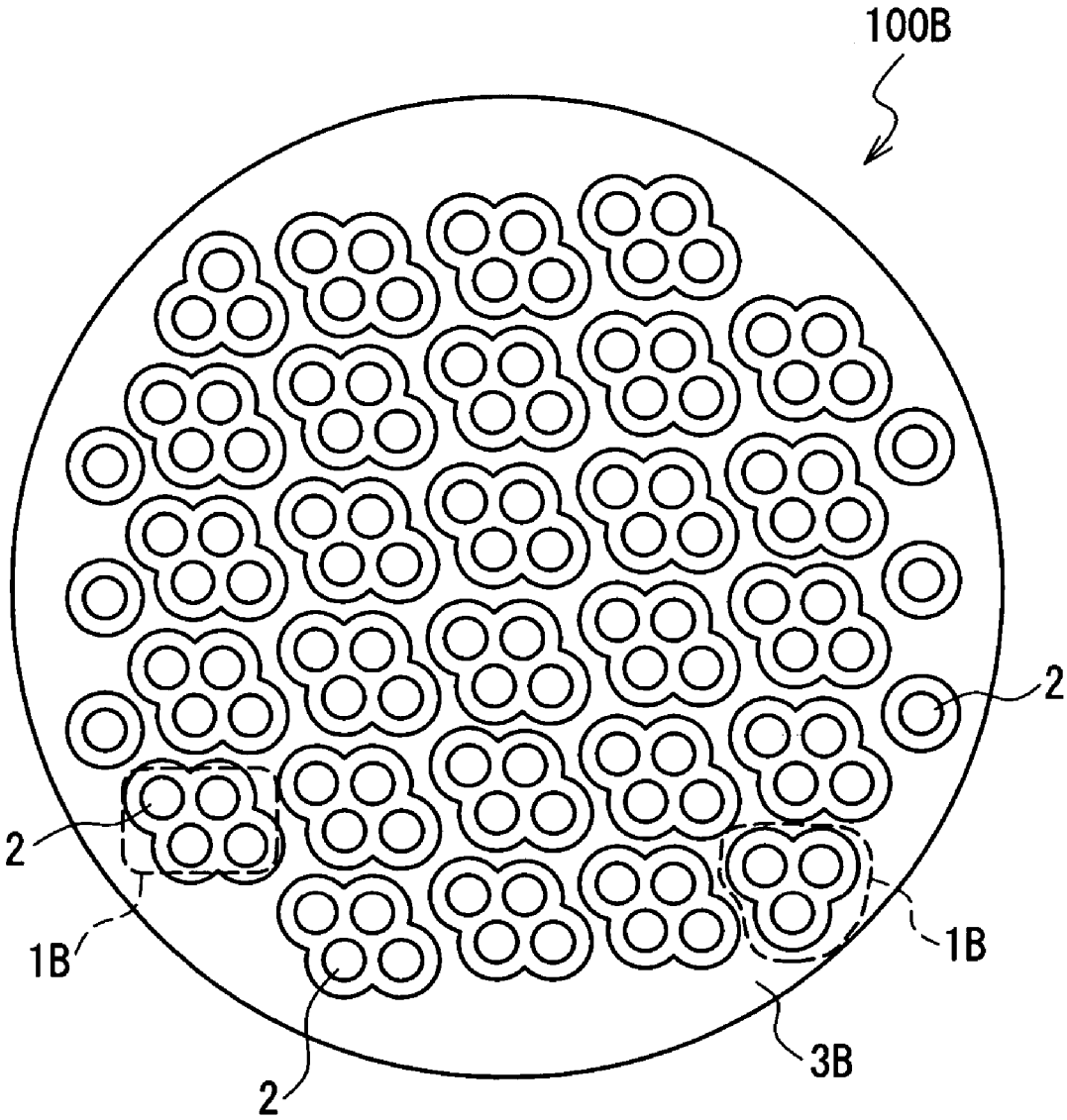
FIG. 4 is a plan view showing a configuration of a field emission electron source according to Embodiment 3.

FIG. 4 is a plan view showing a configuration of a field emission electron source 100B according to Embodiment 3. The component elements having the same configurations as the field emission electron source 100 in Embodiment 1 described with the reference to FIGS. 1A and 1B are denoted with the same reference numerals as those therein, and the description thereof will be omitted here.

The emitter groups 1B in almost all openings are composed of four emitters 2. Furthermore, in the peripheral region, in order to use an extraction electrode 3B having a circular-shaped periphery more efficiently, some of the emitter groups 1B may be composed of three emitters 2 or may be composed of a single emitter 2. In this way, by designing the number of emitters constituting the emitter group and a method for arranging emitters, etc., in order to arrange the emitters 2 with higher density, a field emission electron source with a large current density can be obtained.

Figure 5A:
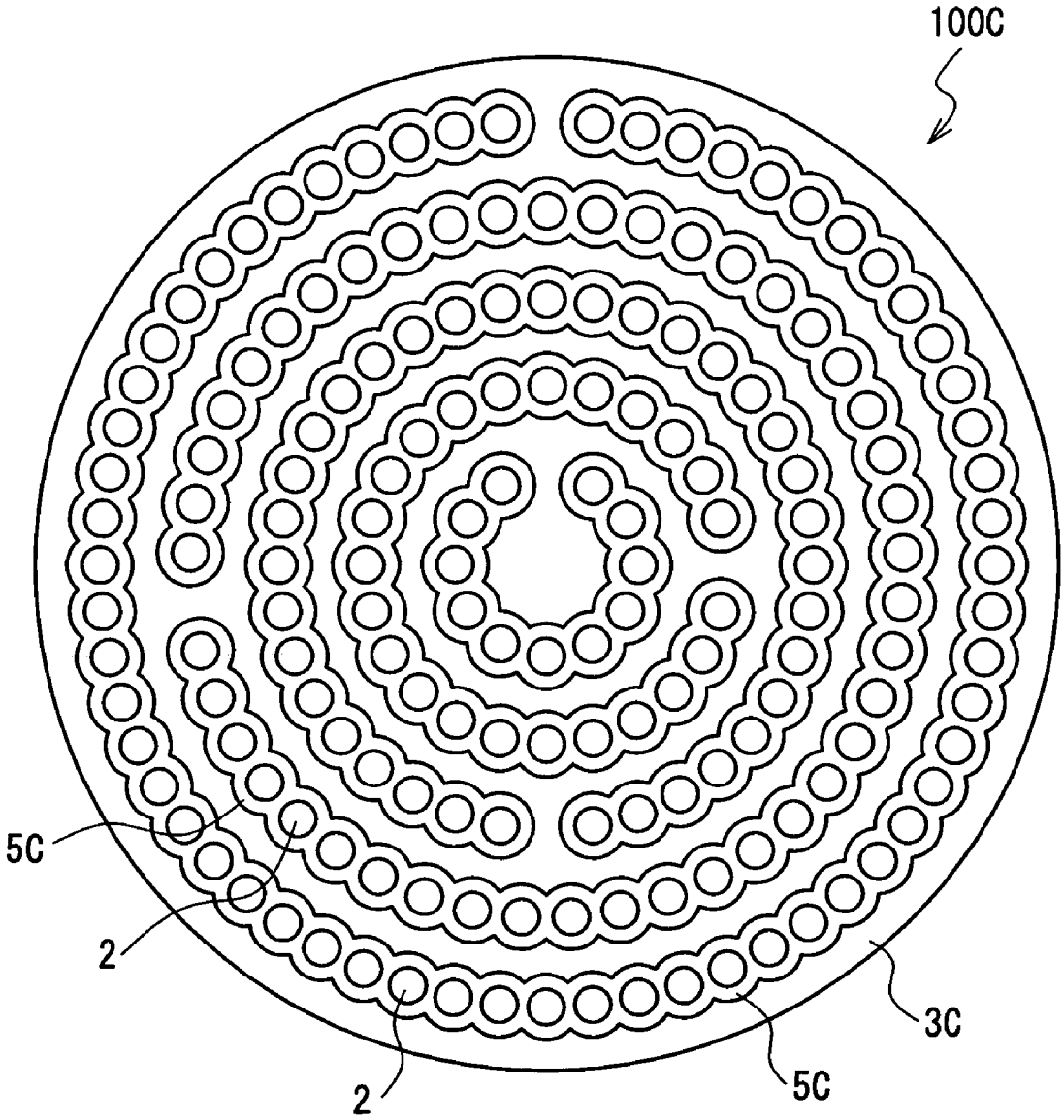
FIG. 5A is a plan view showing a configuration of another field emission electron source according to Embodiment 3.

FIG. 5A is a plan view showing a configuration of another field emission electron source 100C according to Embodiment 3.

As shown in FIG. 5A, emitters 2 which constitute the emitter group may be arranged in an arc shape in a plurality of arc-shaped openings 5C. Also in this case, an electric field from the extraction electrode 3C to each emitter 2 becomes uniformly. Therefore, a field emission of a large current can be achieved.

Figure 5B:
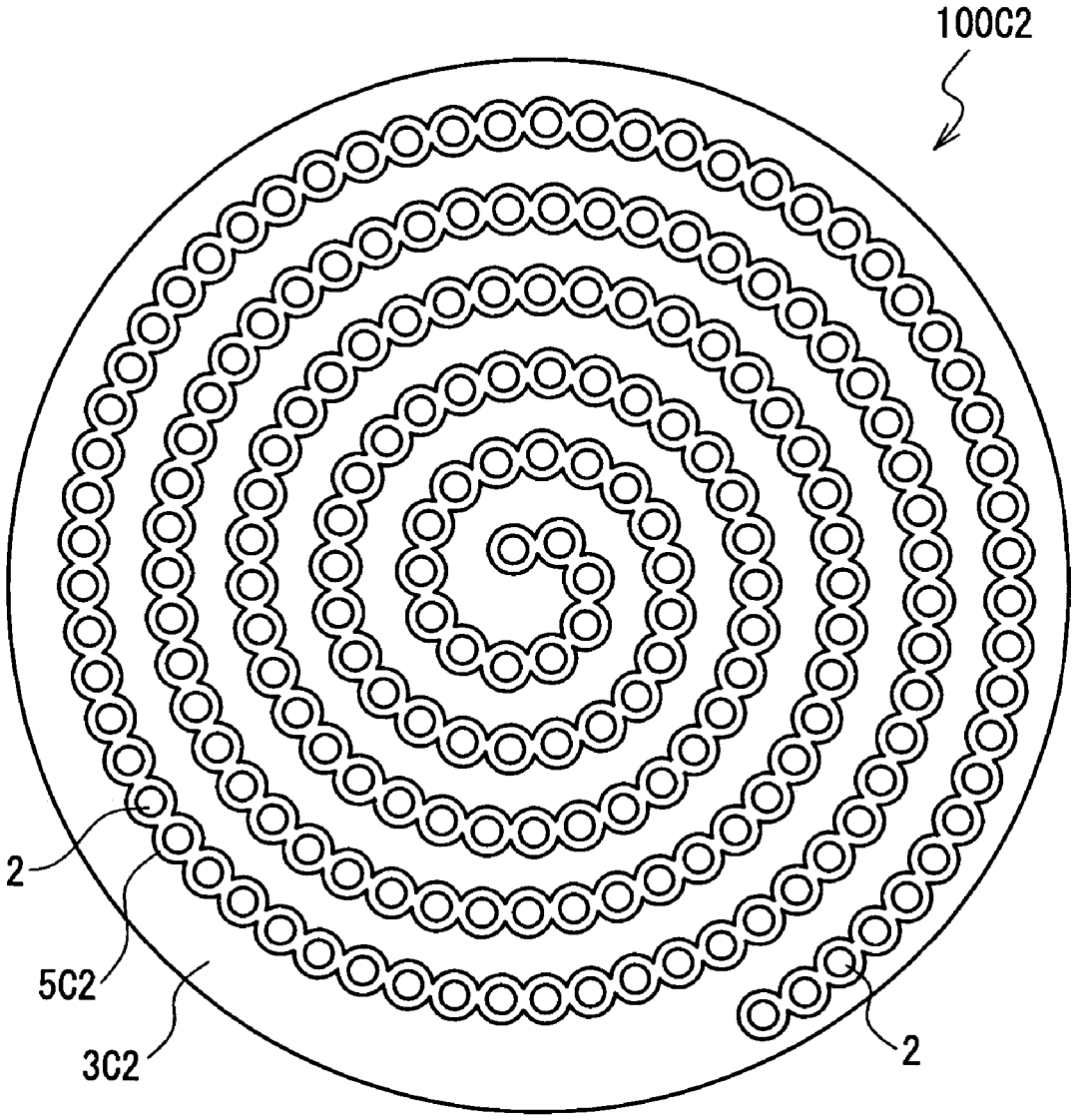
FIG. 5B is a plan view showing a configuration of a further field emission electron source according to Embodiment 3.

FIG. 5B is a plan view showing a configuration of a further field emission electron source according to Embodiment 3. As shown in FIG. 5B, a plurality of emitters 2 may be arranged in spiral shape in an opening formed in a spiral shape. Also in this case, an electric field from the extraction electrode 3C to each emitter 2 becomes uniform. Therefore, excellent electron emission of a large current can be achieved.

EMBODIMENT 4

Figure 6A:
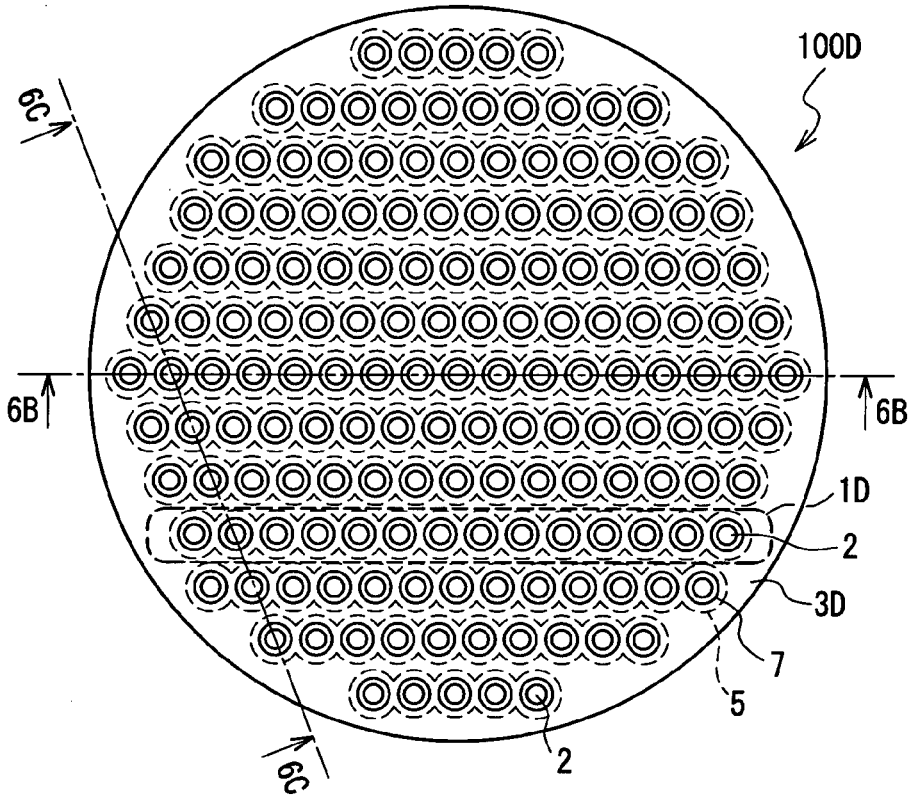
FIG. 6A is a plan view showing a configuration of a field emission electron source according to Embodiment 4.
Figure 6B:
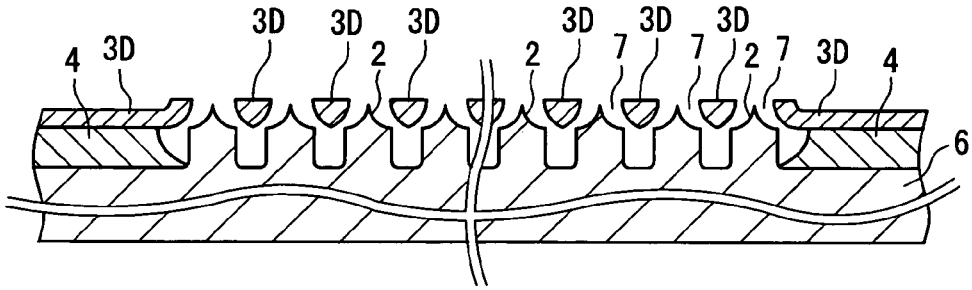
FIG. 6B is a cross-sectional view taken on line 6B—6B of FIG. 6A.
Figure 6C:
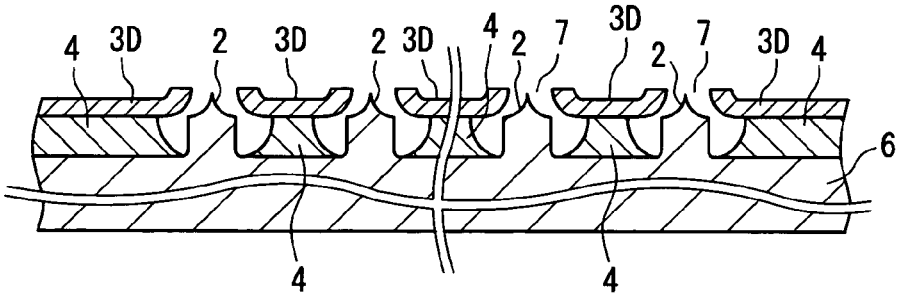
FIG. 6C is a cross-sectional view taken on line 6C—6C of FIG. 6A.

FIG. 6A is a plan view showing a configuration of a field emission electron source 100D according to Embodiment 4; FIG. 6B is a cross-sectional view taken on line 6B—6B of FIG. 6A; and FIG. 6C is a cross-sectional view taken on line 6C—6C of FIG. 6A. The component elements having the same configurations as the field emission electron source 100 in Embodiment 1 described with the reference to FIGS. 1A and 1B are denoted with the same reference numerals as those therein, and the description thereof will be omitted here.

The difference between the field emission electron source 100D and the field emission electron source 100 described above is that the extraction electrode 3D is extended onto the opening of an insulating layer 4 and has electrode openings 7 each being formed along the plurality of emitters 2 in the opening. The emitter groups 1D are separated from each other by the insulating layer 4.

With such a configuration, it is possible to obtain emission current with high current density. In addition, in particular, under a weak electric field in which electric field from the extraction electrode is weak, emission current density can be stabilized.

Figure 7:
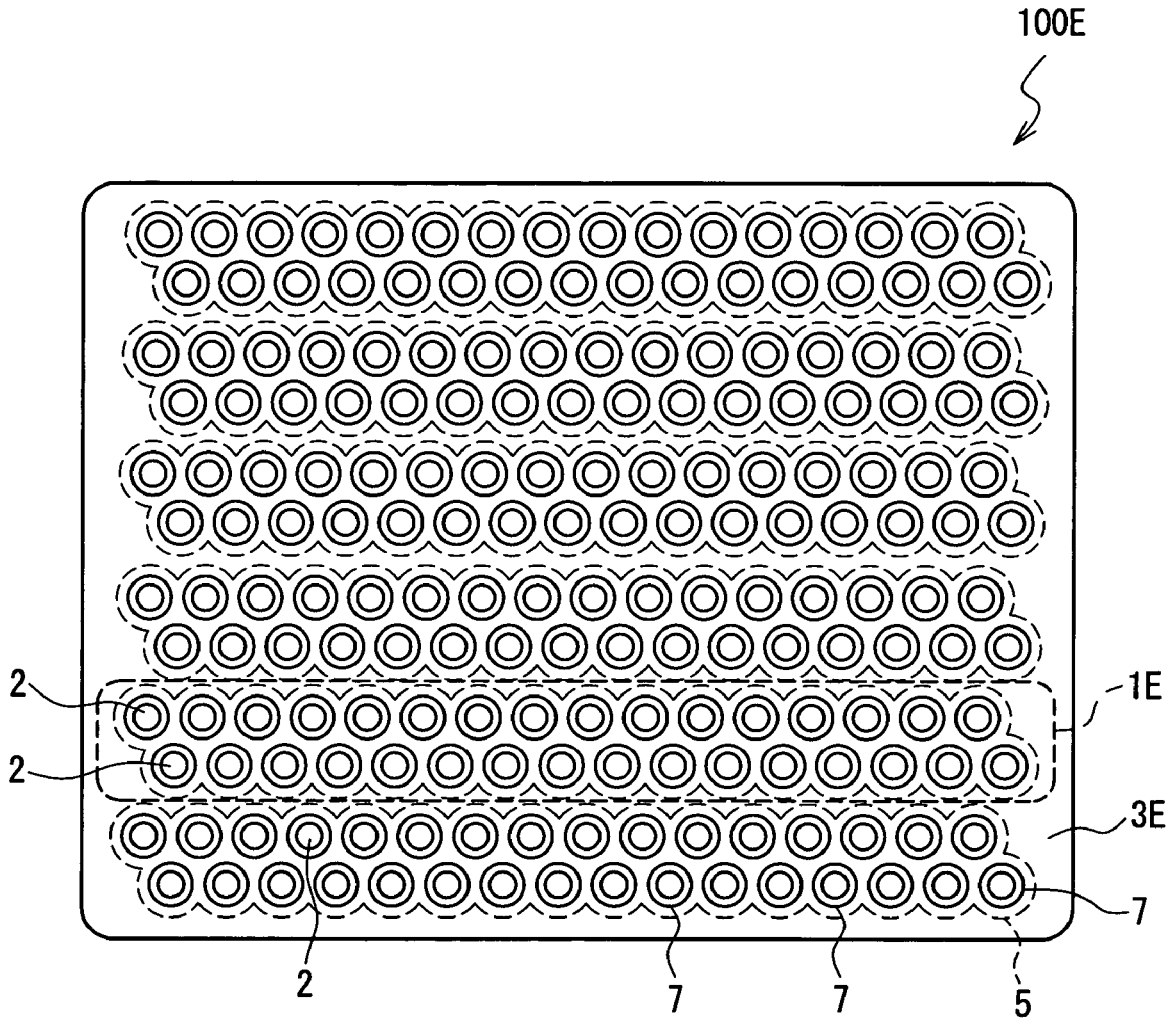
FIG. 7 is a plan view showing a configuration of another field emission electron source according to Embodiment 4.

FIG. 7 is a plan view showing a configuration of another field emission electron source 100E according to Embodiment 4. The component elements having the same configurations as the field emission electron source 100D in Embodiment 4 described with the reference to FIGS. 6A and 6C are denoted with the same reference numerals as those therein, and the description thereof will be omitted here.

The difference between the field emission electron source 100E and the field emission electron source 100D described above is that a plurality of emitters 2 arranged in two rows constitute a emitter group 1E. The emitter groups 1E are separated from each other by an insulating layer.

Note here that in the field emission electron sources 100D and 100E shown in FIGS. 6A to 6C and FIG. 7, since extraction electrodes 3D and 3E are extended onto the openings 5 of the insulating layer 4, emitters are required to be arranged with higher density also considering the mechanical strength of the extraction electrode. Therefore, it is preferable that when the diameter of the emitter is made to be about 0.1 μm, the width of the extraction electrode between the emitters is secured to be about 0.1 μm. Furthermore, to avoid jump-in of electrons into the extraction electrode, it is preferable that the distance from the center of one emitter to the center of the other adjacent emitter is about 0.4 μm.

EMBODIMENT 5

Figure 8A:
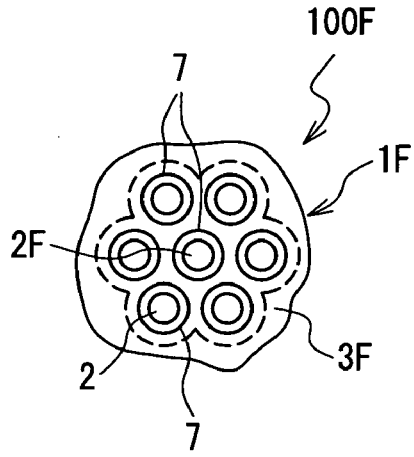
FIG. 8A is a plan view showing a configuration of a main portion of a field emission electron source according to Embodiment 5.

FIG. 8A is a plan view showing a configuration of a main portion of a field emission electron source 100F according to Embodiment 5. Unlike the above-mentioned Embodiments 1 to 4, the emitter group 1F shown in FIG. 8A includes emitter 2F that does not have a surrounding insulating layer functioning as a separating wall. This emitter 2F is surrounded by the other emitters 2.

Figure 8B:
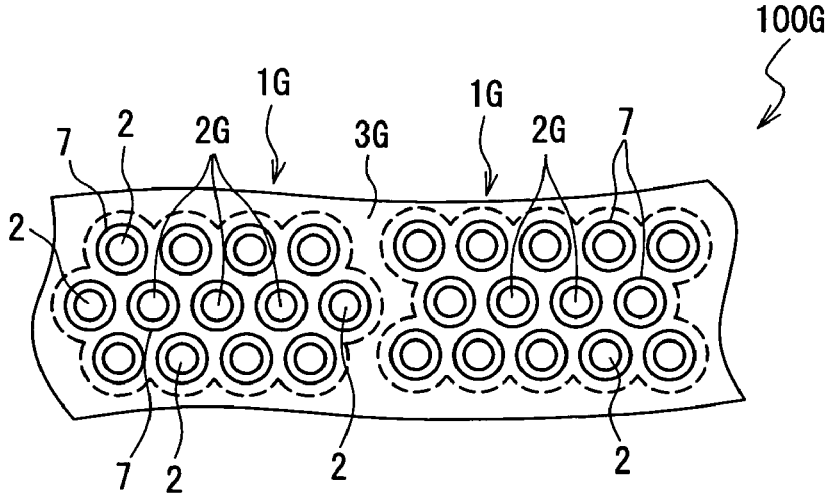
FIG. 8B is a plan view showing a configuration of a main portion of another field emission electron source according to Embodiment 5.

FIG. 8B is a plan view showing a configuration of a main portion of another field emission electron source 100G according to Embodiment 5. The emitter group 1G shown in FIG. 8A includes emitters 2G that do not have a surrounding insulating layer functioning as a separating wall. These emitters 2G are surrounded by the other emitters 2.

Figure 8C:
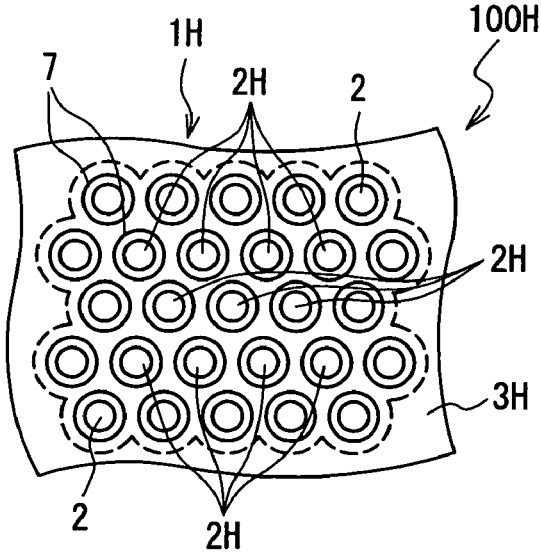
FIG. 8C is a plan view showing a configuration of a main portion of a further field emission electron source according to Embodiment 5.

FIG. 8C is a plan view showing a configuration of a main portion of another field emission electron source 100H according to Embodiment 5. The emitter group 1H shown in FIG. 7C includes emitters 2H that do not have a surrounding insulating layer functioning as a separating wall. These emitters 2H are surrounded by the other emitters 2.

Thus, also in the configuration in which emitters do not have a surrounding insulating layer functioning as a separating layer, similar to the above-mentioned Embodiments 1 to 4, it is possible to obtain an emitting current with high current density.

In the case of this configuration, the number of emitters that do not have a surrounding insulating layer functioning as a separating wall does not have an upper limit. However, if too many emitters that do not have a surrounding insulating layer are concentrated too densely, the mechanical strength of the extraction electrode 3F, 3G, and 3H extended onto the opening of the insulating layer may not be maintained. Therefore, the number of emitters that do not have a surrounding insulating layer is required to be appropriately adjusted in view of the kinds of materials of the extraction electrode, film thickness of the extraction electrode and pitch between emitters, etc.

In Embodiments 1 to 5 as mentioned above, the dimension of component elements is described as one example, respectively. Such dimension can be made finer in accordance with the development of the exposure technology or etching technology. Accordingly, emitters with higher density can be achieved. Furthermore, basically, since a conventional process of semiconductor can be used as it is, it is advantageous from the viewpoint of the mass productivity, reproductivity, stability, etc.

When the field emission electron source according to this Embodiment is used as an electron source for an electron gun of an electron tube, as compared with a conventional field emission electron source having the same emitter region and the same emitter diameter (adjacent gate openings are not connected to each other), about 30% or more increase in electric current amount can be obtained. Furthermore, in the case where the field emission electron source according to this embodiment emits electrons at the same current amount as that of the conventional field emission electron source, since the emitters are arranged with high density, in this embodiment having a larger number of emitters, the load applied to the individual emitter can be reduced. Therefore, it is possible to obtain an electron gun that has less deterioration with the passage of time than that of the conventional example.

Furthermore, since the current amount per area is increased, if it is sufficient to obtain the same current amount as that of a conventional electron source, the size of the emitter region can be made smaller than the conventional example. Thus, the spot diameter of the electron beam can be smaller than the conventional example by 30% or more and an electron tube with high-resolution density can be provided.

Figure 9:
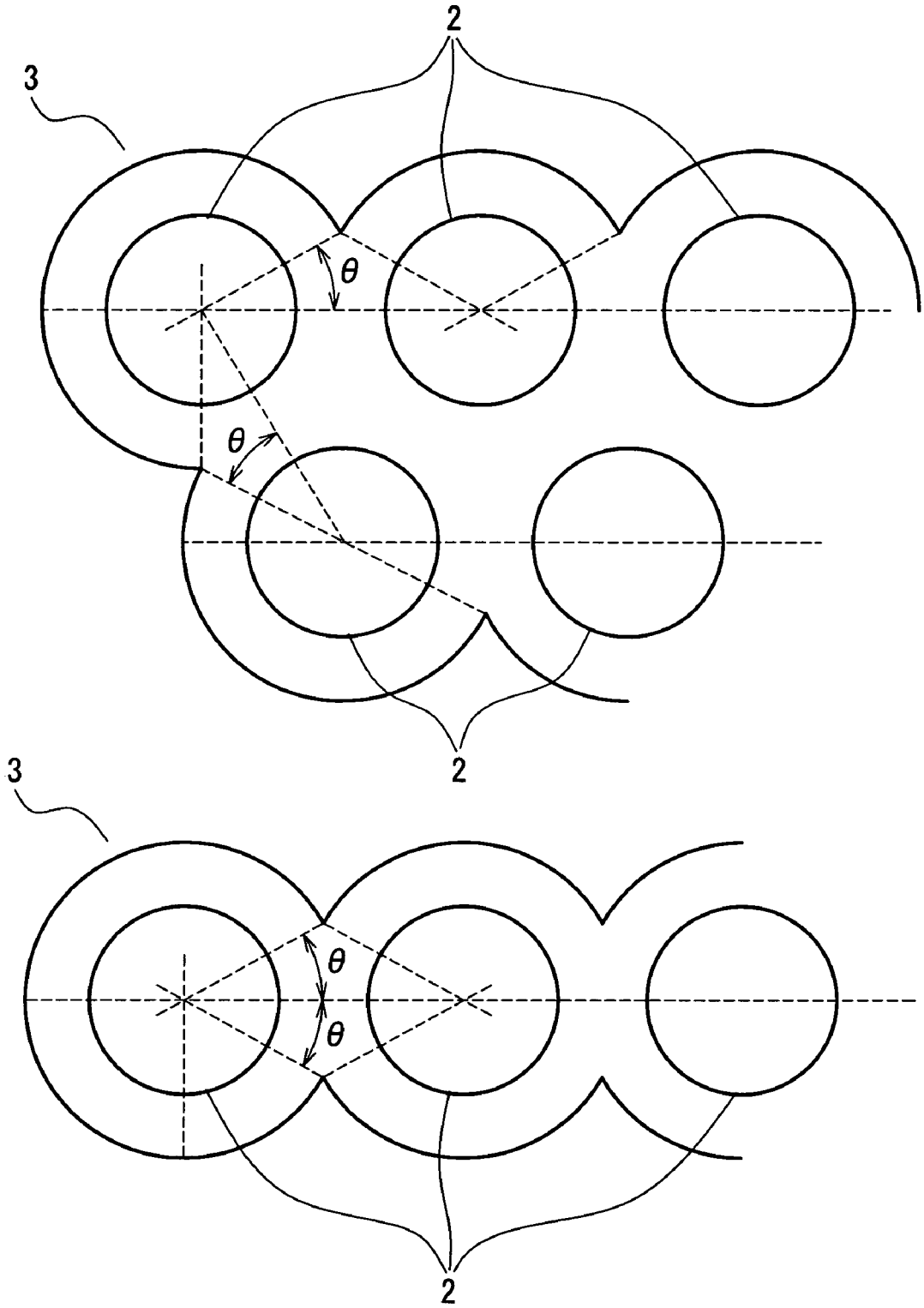
FIG. 9 is a plan view showing a configuration of a main portion of a further field emission electron source according to Embodiment 5.
Figure 10A:
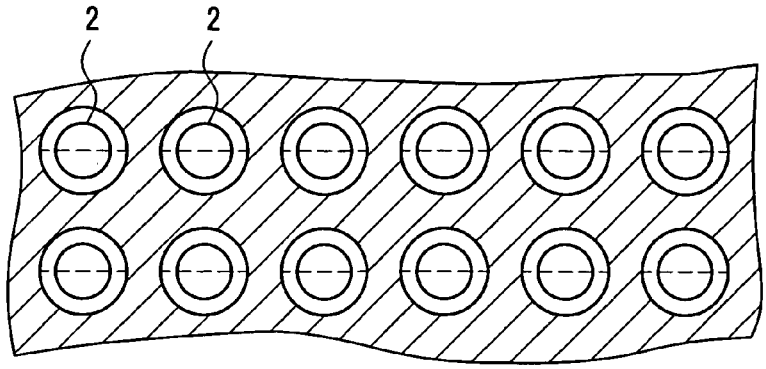
FIG. 10A PRIOR ART
FIGS. 10A is a plan view showing a configuration of a conventional field emission electron source.
Figure 10B:
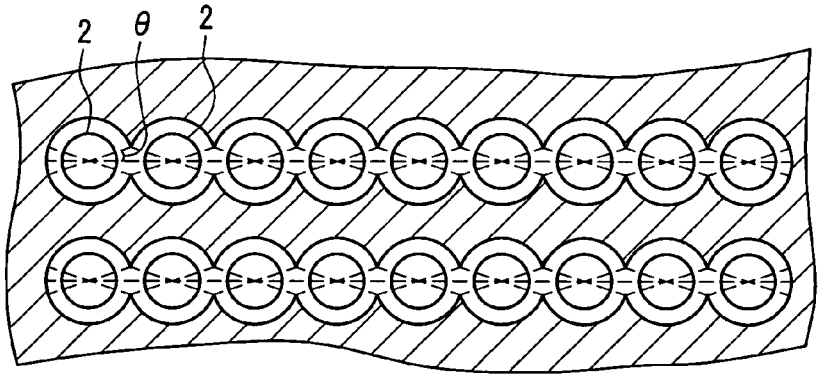
FIGS. 10B to 10D are plan views respectively showing a configuration of a further field emission electron source according to Embodiment 5.
Figure 10C:
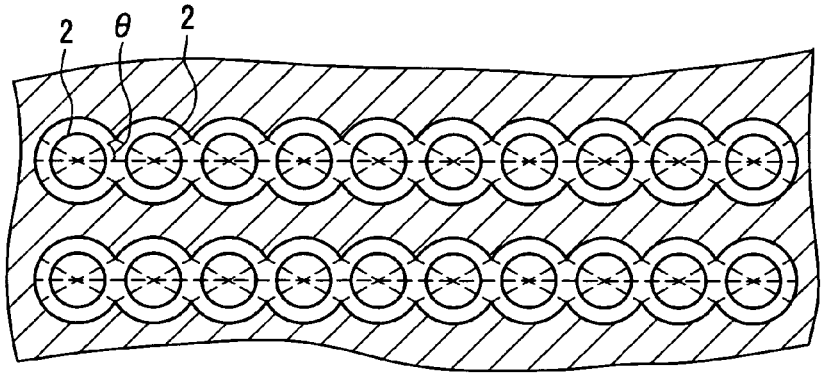
Figure 10D:
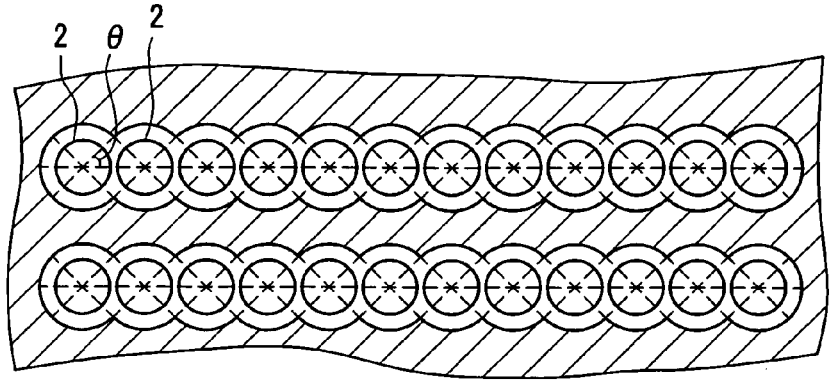
Figure 11A:
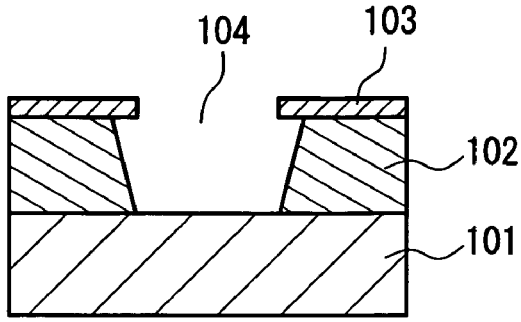
FIG. 11A PRIOR ART
FIGS. 11A to 11D are cross-sectional views showing a method for manufacturing a conventional field emission electron source.
Figure 11B:
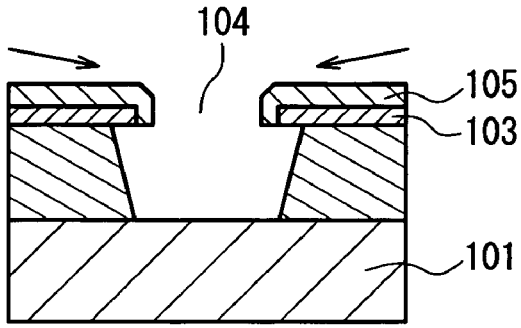
FIG. 11B PRIOR ART
Figure 11C:
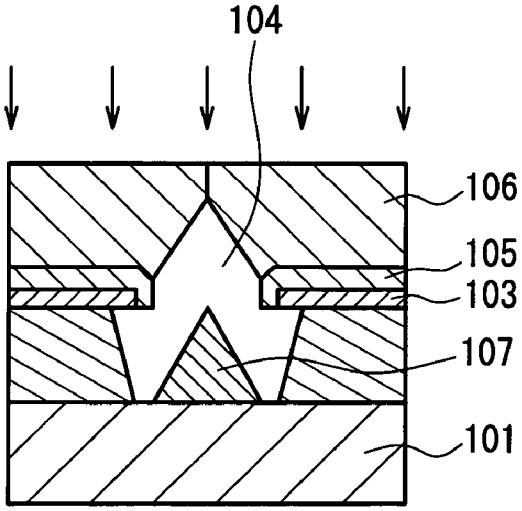
FIG. 11C PRIOR ART
Figure 11D:
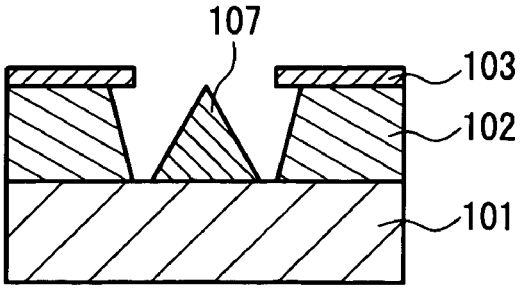
FIG. 11D PRIOR ART
Figure 12A:
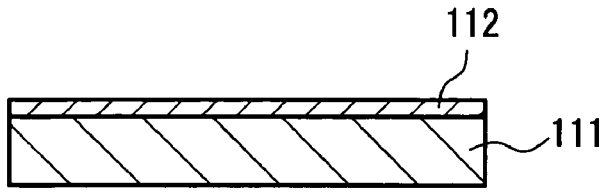
FIG. 12A PRIOR ART
FIGS. 12A to 12E are cross-sectional views showing a method for manufacturing another conventional field emission electron source.
Figure 12B:
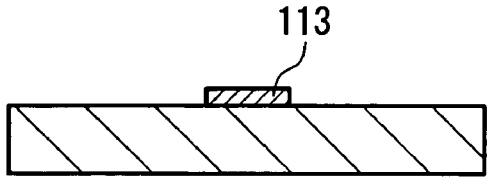
FIG. 12B PRIOR ART
Figure 12C:
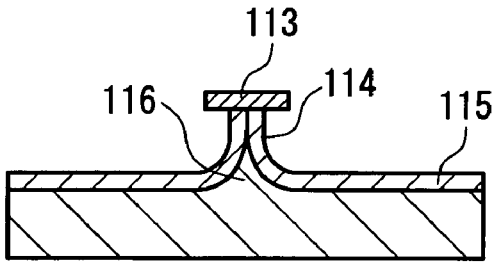
FIG. 12C PRIOR ART
Figure 12D:
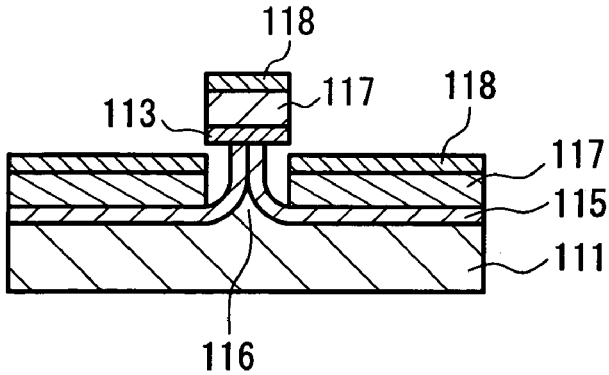
FIG. 12D PRIOR ART
Figure 12E:
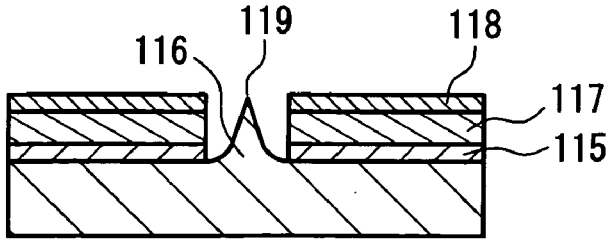
FIG. 12E PRIOR ART
Figure 13A:
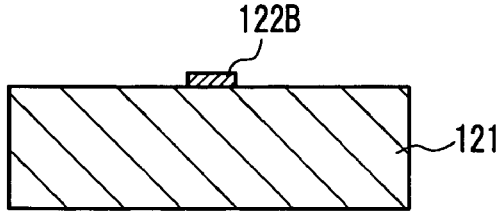
FIG. 13A PRIOR ART
FIGS. 13A to 13H are cross-sectional views showing a method for manufacturing a further conventional field emission electron source.
Figure 13B:
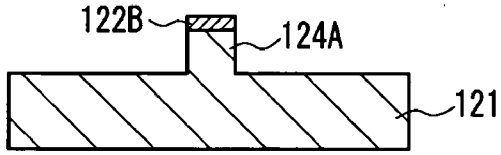
FIG. 13B PRIOR ART
Figure 13C:
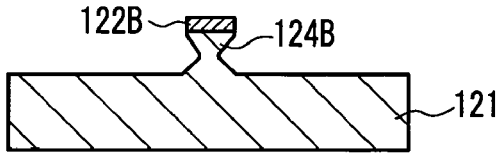
FIG. 13C PRIOR ART
Figure 13D:
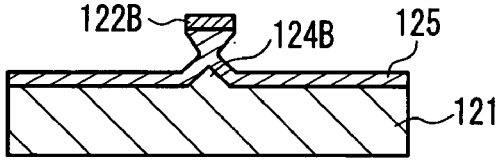
FIG. 13D PRIOR ART
Figure 13E:
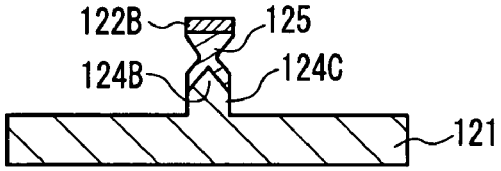
FIG. 13E PRIOR ART
Figure 13F:
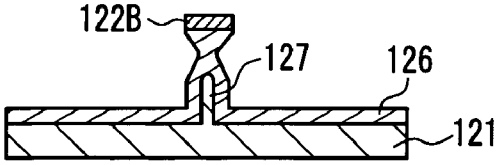
FIG. 13F PRIOR ART
Figure 13G:
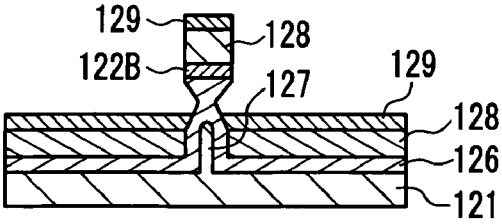
FIG. 13G PRIOR ART
Figure 13H:
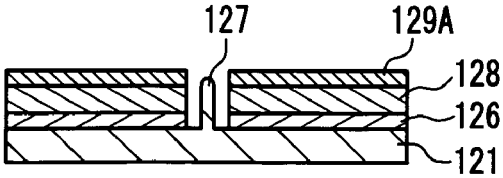
FIG. 13H PRIOR ART
Figure 14A:
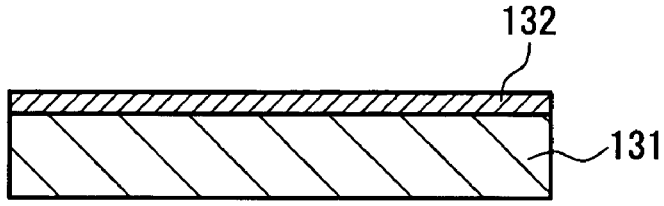
FIG. 14A PRIOR ART
FIGS. 14A to 14E are cross-sectional views showing a method for manufacturing a further conventional field emission electron source.
Figure 14B:
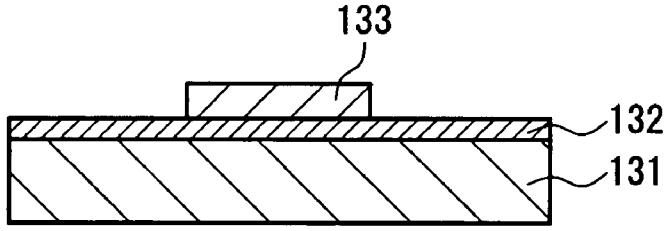
FIG. 14B PRIOR ART
Figure 14C:
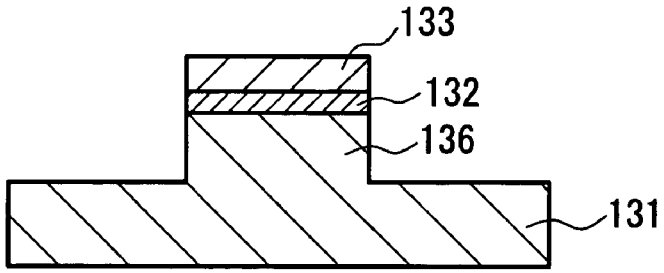
FIG. 14C PRIOR ART
Figure 14D:
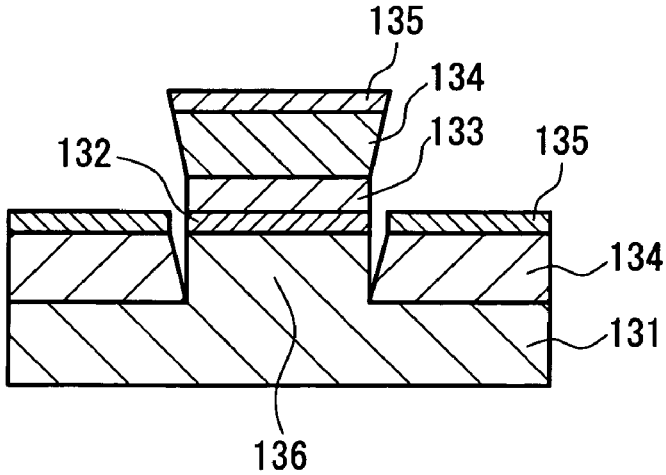
FIG. 14D PRIOR ART
Figure 14E:
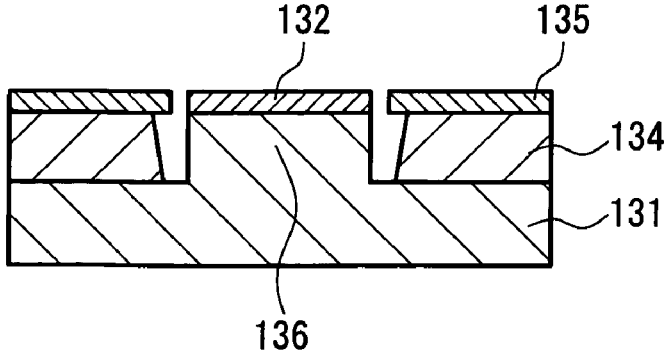
FIG. 14E PRIOR ART

Note here that as to the shape of the extraction electrode 3, as shown in FIG. 9, it is preferable that when an angle made by a line connecting the centers of the adjacent emitters 2 and a virtual line connecting between a center and an interrupted portion of the periphery of the opening of the extraction electrode 3 is made to be θ, the angle θ is made to have a maximum of 45° or less. When the angle θ is made to be larger, the density of emitters can be increased and thus the current density per area can be increased. For example, as shown in FIGS. 1A and 6A, in the case where the emitters are arranged in a row, an opening diameter of the gate electrode is made to be 0.5 μm. As shown in FIGS. 10A to 10D, as compared with the conventional field emission electron source in which θ is 0° the pitch between emitters is 0.7 μm, on the other hand, θ is increased such that θ is 20° (the pitch between emitters is 0.47 μm); θ is 30° (the pitch between emitters is 0.43 μm); and θ is 45° (the pitch between emitters is 0.35 μm). As θ is increased, the density of emitters can be made to about 1.5 times, about 1.6 times, and about 2.0 times, respectively.

As mentioned above, in the field emission electron sources according to Embodiments 1 to 5, as to all the emitters, a clearance between each emitter and an extraction electrode is made to be smaller than a distance between the center of emitter and the center of the other adjacent emitter. Thus, the extraction electrode overlaps the region in a virtual circle having a radius that is equal to the distance between the center of the emitter to the center of the other adjacent emitter. Thereby, when a predetermined voltage is applied to the extraction electrode, distribution does not occur in a state of the concentration of electric field acting on the all the emitters constituting the emitter group. Therefore, it is possible to make the emission of the current to be efficient and uniform.

Furthermore, in the field emission electron source according to Embodiments 1 to 5, to a portion opposite to the emitter of the extraction electrode, an assembly of a plurality of fine fibers such as carbon nanotube may also be formed.

It is apparent from its configuration that the field emission electron source according to Embodiments 1 to 5 may be used as a cold cathode electron source of a flat panel display such as a field emission type display.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A field emission electron source, comprising:

a plurality of emitters formed on a surface of a substrate;

an insulation layer formed on the substrate, the insulation layer including an opening formed therein so that the plurality of emitters are disposed in the opening; and an extraction electrode formed on the insulation layer, the extraction electrode including an opening formed therein so that the plurality of emitters are disposed in the opening, wherein when the field emission electron source is viewed along a direction normal to the surface of the substrate, a shape of a periphery of the opening of the extraction electrode comprises at least two adjacent arcs that are concentric with at least two adjacent emitters, respectively, among the plurality of emitters, wherein a radius of each of the at least two arcs is larger than a half of a distance between centers of the at least two emitters.

2. The field emission electron source according to claim 1, wherein each emitter is a conductive protruding microstructure having a steep tip on the surface thereof.

3. The field emission electron source according to claim 1, wherein a clearance between each of the plurality of emitters and the periphery of the opening of the extraction electrode is smaller than a distance between a center of the emitter and a center of an adjacent emitter.

4. The field emission electron source according to claim 1, wherein the plurality of emitters disposed in the opening of the insulation layer are arranged substantially linearly.

5. The field emission electron source according to claim 1, wherein the opening of the insulation layer has substantially an elongated-hole shape and a plurality of the openings each having the substantially elongated-hole shape are arranged in a plurality of rows.

6. The field emission electron source according to claim 1, wherein the opening of the insulation layer has an arc shape, and in the opening in the arc shape the plurality of emitters are arranged in substantially an arc shape.

7. The field emission electron source according to claim 1, wherein when an angle made by a line connecting the centers of the adjacent emitters and a virtual line connecting between a center of the emitter and an interrupted portion of the periphery of the opening of the extraction electrode is made to be θ, the angle θ is in the range from 15° to 45°.

8. The field emission electron source according to claim 1, wherein at least one of the plurality of emitters disposed in the opening of the insulation layer is surrounded by others of the plurality of emitters.

9. The field emission electron source according to claim 1, wherein the plurality of emitters disposed in the opening of the insulation layer are arranged in two rows.

10. A field emission electron source, comprising:

a plurality of emitters formed on a surface of a substrate;

an insulation layer formed on the substrate, the insulation layer including an opening formed therein so that the plurality of emitters are disposed in the opening; and an extraction electrode formed on the insulation layer, the extraction electrode including a plurality of openings formed therein having one-to-one correspondence with the plurality of emitters so that the plurality of emitters are disposed in the respective openings, wherein when the field emission electron source is viewed along a direction normal to the surface of the substrate, a shape of a periphery of the opening of the insulation layer comprises at least two adjacent arcs that are concentric with at least two adjacent emitters, respectively, among the plurality of emitters, wherein a radius of each of the at least two arcs is larger than a half of a distance between centers of the at least two emitters.

11. The field emission electron source according to claim 10, wherein each emitter is a conductive protruding microstructure having a steep tip on the surface thereof.

12. The field emission electron source according to claim 10, wherein a clearance between each of the plurality of emitters and the periphery of the opening of the insulation layer is smaller than a distance between a center of the emitter and a center of an adjacent emitter.

13. The field emission electron source according to claim 10, wherein the plurality of emitters disposed in the opening of the insulation layer are arranged substantially linearly.

14. The field emission electron source according to claim 10, wherein the opening of the insulation layer has substantially an elongated-hole shape and a plurality of the openings each having the substantially elongated-hole shape are arranged in a plurality of rows.

15. The field emission electron source according to claim 10, wherein the opening of the insulation layer has an arc shape, and in the opening in the arc shape the plurality of emitters are arranged in substantially an arc shape.

16. The field emission electron source according to claim 10, wherein the extraction electrode is extended onto the opening of the insulating layer.

17. The field emission electron source according to claim 10, wherein at least one of the plurality of emitters disposed in the opening of the insulation layer is surrounded by others of the plurality of emitters.

18. The field emission electron source according to claim 10, wherein the plurality of emitters disposed in the opening of the insulation layer are arranged in two rows.

* * * * *